US009180361B2

(12) United States Patent
Walker, Jr.

(10) Patent No.: US 9,180,361 B2
(45) **Date of Patent: *Nov. 10, 2015**

(54) PRESSURE ACTIVATED BALL GAME

(71) Applicant: Wilmer David Walker, Jr., Atlanta, GA (US)

(72) Inventor: Wilmer David Walker, Jr., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/560,986

(22) Filed: Dec. 4, 2014

(65) Prior Publication Data

US 2015/0084278 A1 Mar. 26, 2015

Related U.S. Application Data

(63) Continuation of application No. 13/269,227, filed on Oct. 7, 2011, now Pat. No. 8,932,099.

(51) Int. Cl.

| | |
|---|---|
| ***A63F 7/04*** | (2006.01) |
| ***A63F 7/24*** | (2006.01) |
| *A63F 7/28* | (2006.01) |
| *A63F 7/34* | (2006.01) |

(52) U.S. Cl.

CPC . *A63F 7/04* (2013.01); *A63F 7/249* (2013.01); *A63F 7/2418* (2013.01); *A63F 7/2472* (2013.01); *A63F 2007/282* (2013.01); *A63F 2007/343* (2013.01); *A63F 2007/346* (2013.01)

(58) Field of Classification Search

USPC ..... 446/176, 186, 197

See application file for complete search history.

(56) References Cited

U.S. PATENT DOCUMENTS

| | | | | | |
|---|---|---|---|---|---|
| 943,472 | A | * | 12/1909 | Schreiber | 273/317.3 |
| 1,850,715 | A | * | 3/1932 | Gottfried | 273/405 |
| 1,958,563 | A | * | 5/1934 | Brooker et al. | 463/60 |
| 2,129,489 | A | * | 9/1938 | Brown | 124/56 |
| 2,919,135 | A | * | 12/1959 | Marchionda | 273/119 B |
| 3,208,185 | A | * | 9/1965 | Silvera | 446/137 |
| 3,264,782 | A | * | 8/1966 | Glass et al. | 446/435 |
| 3,469,340 | A | * | 9/1969 | Breneman et al. | 446/197 |
| 3,570,171 | A | * | 3/1971 | Shook | 446/173 |
| 3,643,953 | A | * | 2/1972 | Fixler | 273/119 B |
| 3,711,097 | A | * | 1/1973 | Begley | 273/357 |
| 3,805,442 | A | * | 4/1974 | Matlack | 446/186 |
| 3,810,629 | A | * | 5/1974 | Yamamoto | 273/144 A |
| 3,949,518 | A | * | 4/1976 | Lenza | 446/186 |
| 3,973,774 | A | * | 8/1976 | Breslow et al. | 124/79 |
| 3,997,157 | A | * | 12/1976 | Meyer | 273/440 |
| 4,042,243 | A | * | 8/1977 | Hoel et al. | 273/108 |
| 4,079,937 | A | * | 3/1978 | Kirsch | 273/317.3 |
| 4,132,214 | A | * | 1/1979 | Schnurr et al. | 124/1 |
| 4,136,872 | A | * | 1/1979 | Matsumoto | 273/317.3 |
| 4,159,705 | A | * | 7/1979 | Jacoby | 124/63 |
| 4,186,927 | A | * | 2/1980 | Breslow et al. | 273/357 |
| 4,207,857 | A | * | 6/1980 | Balka, Jr. | 124/56 |

(Continued)

*Primary Examiner* — Melba Bumgarner
*Assistant Examiner* — Joseph B Baldori
(74) *Attorney, Agent, or Firm* — McGurk Intellectual Property Advisors

(57) ABSTRACT

A game device has a ball-activating chamber attached to a central, ball-receiving chamber. Participants compress a pressure mechanism that causes the release of a ball in the ball-activating chamber into the central, ball-receiving chamber. The ball may be acted upon when in the central chamber to add an element of randomness to the game. The central chamber may be at least partially or fully transparent or translucent to allow the participants and/or spectators to view the ball as it travels through the central chamber, ultimately ending at a holding bin. Having more than one ball-activating chamber, the game device may be configured to resemble an octopus.

6 Claims, 9 Drawing Sheets

(56) References Cited

U.S. PATENT DOCUMENTS

| | | | | | |
|---|---|---|---|---|---|
| 4,209,940 | A | * | 7/1980 | Meyer et al. | 446/300 |
| 4,227,690 | A | * | 10/1980 | Pitkanen | 273/445 |
| 4,250,657 | A | * | 2/1981 | Barlow et al. | 446/178 |
| 4,266,767 | A | * | 5/1981 | Spring | 273/447 |
| 4,418,908 | A | * | 12/1983 | Kinberg | 273/445 |
| 4,468,029 | A | * | 8/1984 | Kulesza et al. | 273/108 |
| 4,568,302 | A | * | 2/1986 | Henderson | 446/186 |
| 4,900,026 | A | * | 2/1990 | Kulesza et al. | 273/119 A |
| 4,925,188 | A | * | 5/1990 | McKay et al. | 463/59 |
| 4,990,118 | A | * | 2/1991 | Shiina | 446/197 |
| 5,017,171 | A | * | 5/1991 | Shiina | 446/197 |
| 5,188,556 | A | * | 2/1993 | Hartelius et al. | 446/172 |
| 5,263,714 | A | * | 11/1993 | Rudell et al. | 273/138.1 |
| 5,335,917 | A | * | 8/1994 | Kuna | 273/445 |
| 5,344,142 | A | * | 9/1994 | Barreira | 273/317.4 |
| 5,403,018 | A | * | 4/1995 | Sejnowski et al. | 273/394 |
| 5,928,053 | A | * | 7/1999 | Henderson | 446/153 |
| 6,102,405 | A | * | 8/2000 | Spikes | 273/405 |
| 6,527,619 | B1 | * | 3/2003 | Agostini et al. | 446/435 |
| 6,722,887 | B2 | * | 4/2004 | Polonio | 434/237 |
| 7,708,002 | B2 | * | 5/2010 | Gerardo | 124/73 |
| 8,932,099 | B2 | * | 1/2015 | Walker, Jr. | 446/197 |
| 2008/0020672 | A1 | * | 1/2008 | Osborn | 446/227 |
| 2009/0071137 | A1 | * | 3/2009 | Harris | 60/325 |
| 2013/0090035 | A1 | * | 4/2013 | Walker, Jr. | 446/176 |

* cited by examiner

PRESSURE ACTIVATED BALL GAME

This application is a continuation of U.S. Non-provisional application Ser. No. 13/269,227 filed on Oct. 7, 2011 and which is hereby incorporated by reference in its entirety herein to provide continuity of disclosure.

FIELD OF THE INVENTION

The present invention relates, generally, to games and/or entertainment devices; and, more particularly, to a human-activated ball game, wherein air pressure generated from a user stepping onto, or otherwise pressing upon or squeezing, an air bladder or air chamber expels a ball into a receiving chamber, wherein the ball is subsequently directed through a path within the chamber and to an exit.

BACKGROUND OF THE INVENTION

Randomness or chance in game devices is a common, even sought-after, characteristic or aspect of game play. For example, every game that uses a die has an element of randomness or chance. The outcome of a player's "turn" depends at least in part on the numbers that appear when the die is rolled. Another example are games that use cards. As before, the result of a "turn" is at least dependant on the card that is received or able to be used.

But, randomness is only one of the common aspects of game play that add to the enjoyability of a game. Another aspect is the player's own skill. When both skill and chance are combined, the player not only has the benefit of depending upon, at least in part, his or her skill at the game, but also the added effects of randomness or chance, which often adds to the excitement and enjoyment of the game.

These aspects of randomness or chance certainly may be found within children's games. For example, in the long-beloved children's game of "musical chairs," a number of chairs are situated into a ring or oval shape. Most typically, there is provided one-fewer chair than the number of children playing the game. Music is played in the background, typically by an adult, and the children march in a line around the chairs until the music is stopped, wherein each participant instantly scrambles to sit in a nearby chair. Since there is an insufficient number of chairs for all participants, one participant is left standing. That participant is deemed "out" of that round of game-play. A chair is then removed from the ring or oval, the remaining chairs are resituated, and game-play resumes in the same manner. Accordingly, because of randomness or chance introduced into the game by the starting and stopping of the music, by the speed of auditory processing by each participant, and by the physical speed and prowess of each participant in locating and commandeering a chair, each round of game-play is made exciting and enjoyable—at least for all participants finding themselves in a chair at the end of a round.

As anyone who has played or observed musical chairs game-play knows, however, the game can be dangerous to the participants, and destructive to property and surroundings, at least in-part due to the same aspects of randomness and/or chance that make the game so enjoyable to play. For example, when the participants scramble for a nearby chair, it is not uncommon that chaos ensues. Participants may violently collide into each other as paths are crossed, and they may bump or smash into each other when seeking to sit in the same chair. Physical injuries are not uncommon. Even when purely physical injuries do not result, emotions are made raw, tempers often flare, and tears may result from hurt feelings.

Similarly, the game is not easy on the surroundings. For example, chairs may be overturned or sent skidding away as participants scramble to control a chair. Walls and floors may be scratched, dented, or otherwise damaged, and carpet may be torn. Thus, it can be quite apparent that, while randomness and/or chance can serve to enhance the game, they can also detract from it, such as when injuries, hurt feelings, and/or damage to the surroundings occur.

Thus, in recognition of the above-described, pleasurable aspects of such game-play, but remaining mindful of the above-described, detrimental aspects, it was apparent that it would be beneficial to design and develop a new form of interactive game, and associated game-play, modeled loosely upon the game of musical chairs. It was further recognized that such a new game should remove as many of the potentially dangerous, destructive, and otherwise deleterious aspects of the original musical chairs game as possible, while substituting therefor one or more safe, positive, and exciting game-play attributes.

In keeping with such considerations, it was recognized that the elements of randomness and/or chance could, and rightfully should, be maintained through allowing randomness and/or chance to be introduced into the game by means present in the original game; to wit: by the starting and stopping of the music, by the speed of auditory processing by each participant, and by the physical speed and prowess of each participant. It was further recognized that such a new game could be combined with physical movement, exercise, and activity, and/or combinations thereof, on the part of the participants. Notwithstanding, it was also recognized that these elements and attributes should be incorporated into such a new game in a way that would seek to avoid physical injury to both participants and surroundings, principally by avoiding impact, collision, bumping, smashing, or the like, of persons and/or property during game-play. It is, therefore, to the provision of such apparatus and method of game-play that the disclosure of the present invention is directed.

SUMMARY OF THE INVENTION

The present invention, generally, presents a game device that has a ball-activating chamber attached to a central, ball-receiving chamber. Participants in game-play compress a pressure mechanism that causes the release of a ball in the ball-activating chamber into the central, ball-receiving chamber. The ball may be acted upon when in the central chamber to add an element of randomness to the game. The central chamber may be at least partially or fully transparent or translucent to allow the participants and/or spectators to view the ball as it travels through the central chamber, ultimately ending at a holding bin. Having more than one ball-activating chamber, the game device may be configured, in a preferred embodiment, to resemble an octopus.

More specifically, the presently disclosed inventive subject matter is a game device having a first chamber for holding one of a plurality of balls, and a mechanism for causing the release of the ball from the first chamber into a second chamber. In one embodiment, the second chamber has one or more mechanism that directs the balls released into the second chamber to be expelled into a holding bin. In some embodiments, the second chamber has elements that cause randomness, variability, or variation in the release of the balls into the second chamber and, subsequently, into the holding bin.

In a preferred embodiment of the presently disclosed subject matter, a game device having an appearance similar to an octopus is disclosed. In such embodiment, the game device has eight (8) first chambers that are configured to at least partially resemble or represent the arms of an octopus. The portion of the first chamber disposed next to the second chamber, which is configured to resemble or represent the body of an octopus, has disposed therein an aperture into which a ball is placed. Located on the distal end of the first chamber is a pressure mechanism, preferably in the form of a compressible air bladder or air chamber, that causes an increase in pressure in the first chamber, pushing the ball disposed therein to be expelled into the second chamber. In some embodiments, the pressure mechanism is a hollow, compressible foot pad that, when depressed, causes an increase in air pressure in the first chamber.

In another embodiment, the second chamber is a hollow, generally cylindrical chamber that provides a means for transferring the ball into a holding bin. In some embodiments, the second chamber has disposed therein one or more elements or mechanisms that affect or otherwise alter the travel path of the ball into and/or through the second chamber. For example, the second chamber may have barriers with apertures that will impede the flow of the ball from the first chamber into the second chamber. In another embodiment, the second chamber may have "slides" having a curvature about an axis that rotate the ball as it proceeds in a downward motion. In a further embodiment, the walls of the second chamber are at least partially transparent or translucent, allowing the participants and/or spectators to see the plurality of balls as they travel through the second chamber.

In a further embodiment, the holding bin is a cylindrical device that provides for the ability of the participants and/or spectators to see the order in which the balls exit the second chamber. In some embodiments, the holding bin is generally cylindrical with one closed end and one open end, and which is configured to receive the balls as they are expelled from the second chamber. In such an embodiment, the balls collect in the order in which they are expelled. Using various aspects of the previous examples and embodiments, the order in which the balls are expelled may depend upon the order in which they are expelled from their respective first chambers (e.g., skill) and the effect that any element and/or mechanism in the second chamber has on the path and time of travel of the ball through the second chamber (e.g., randomness).

These and other features of the subject matter are described below.

BRIEF DESCRIPTION OF THE DRAWINGS

The foregoing summary, as well as the following detailed description of the subject matter is better understood when read in conjunction with the appended drawings. For the purposes of illustration, there are shown in the drawings certain exemplary embodiments; however, these embodiments are not limited to the specific methods and instrumentalities disclosed. In the drawings.

DETAILED DESCRIPTION OF ILLUSTRATIVE EMBODIMENTS

Certain specific details are set forth in the following description and figures to provide a thorough understanding of various embodiments of the subject matter. Certain well-known details often associated with mechanical components and the construction of mechanical devices are not set forth in the following disclosure in order to avoid unnecessarily obscuring the various embodiments of the subject matter. Further, those of ordinary skill in the relevant art will understand that they can practice other embodiments of the subject matter without one or more of the details described below. Finally, while various methods are described with reference to steps and sequences in the following disclosure, the description as such is for providing a clear implementation of embodiments of the subject matter, and the particular steps and sequences of steps should not be taken as required to practice this subject matter; nor should the order of any such particular steps and sequences of steps be taken as required unless specifically so stated.

Accordingly, the present invention may be understood more readily by reference to the following detailed description taken in connection with the accompanying drawing Figures and exemplary embodiments, which form a part of this disclosure. It is to be understood that this invention is not limited to the specific devices, methods, applications, conditions or parameters described and/or shown herein, and that the terminology used herein is for the purpose of describing particular embodiments by way of example only and is not intended to be limiting of the claimed invention. It is further understood that any reference to any specific shapes, sizes, decorations, indicia, manners of attachment, or other details of construction, unless otherwise specified, are merely for exemplary purposes and are not intended to limit the scope of the presently disclosed subject matter.

Also, as used in the specification including the appended claims, the singular forms "a," "an," and "the" include the plural, and reference to a particular numerical value includes at least that particular value, unless the context clearly dictates otherwise. The term "plurality," as used herein, means more than one. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Figure 1:
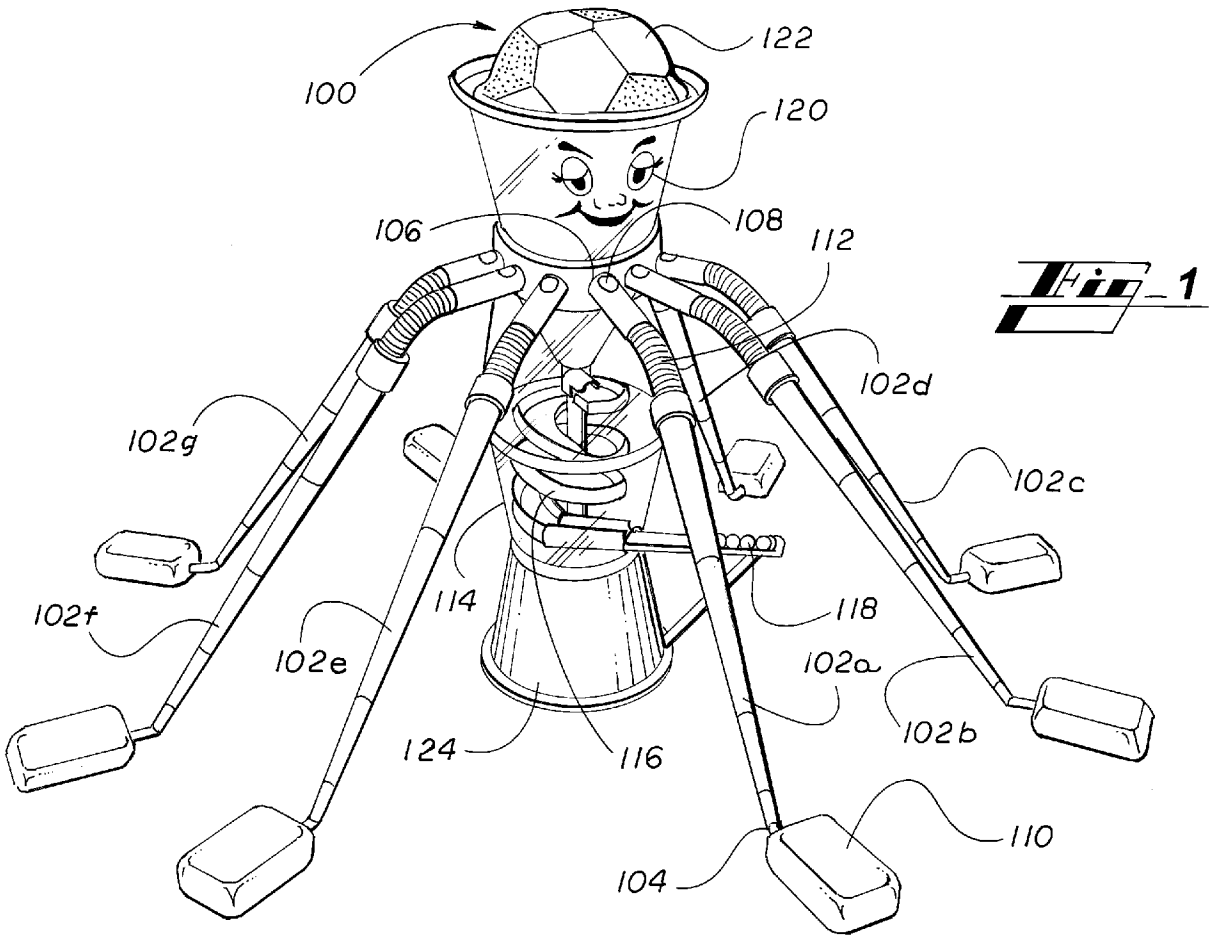
FIG. 1 is an exemplary illustration in perspective view showing the game device.

Referring now to the drawing Figures, FIG. 1 illustrates an exemplary embodiment of game device 100 according to the presently disclosed subject matter. In such embodiment, game device 100 includes a plurality of first chambers 102*a-g* (an eighth chamber is not fully shown). It will be appreciated by those of ordinary skill in the art that the number of first chambers 102 provided in association with game device 100 may be varied in number, size, and scale, to accommodate the requirements of the game designer, the participants, the available space, the required game configuration, or the like, without limitation. To further illustrate the exemplary construction of a first chamber, however, attention is now focused on first chamber 102*a*.

In an exemplary embodiment, chamber 102*a* is a generally hollow, preferably extensible, chamber having first end 104 and second end 106. Attached to first end 104 is pressure mechanism 110. In some embodiments, pressure mechanism 100 may take the form of a compressible air bladder or air chamber, constructed of plastic, thermoplastic, rubber, or any other deformable, but shape-recoverable, material. When depressed, for example by a player's hand, foot, or finger, as may be required or preferred according to the size and/or scale of construction of game device 100, the compression causes an increase in air pressure in chamber 102 that is translated to an increase in pressure in ball holding mechanism 108. Preferably, enough pressure is generated by compression of pressure mechanism 110 to forcefully expel a ball that is disposed in ball holding mechanism 108 into second chamber 114.

To allow for a degree of flexibility of movement for first chamber 102*a*, first chamber 102*a* may be connected to second chamber 114 via generally hollow flexible connector 112. Preferably, flexible connector 112 allows for the movement of first chamber 102*a* in various degrees of motion (i.e. up, down, left, right, in, and/or out). Second chamber 114 may be supported or elevated by base 124, which may provide an elevated playing space, as well as providing for increased stability of device 100. Second chamber 114 is shown as having transparent or translucent walls, which allows participants and/or spectators to see the travel of the ball at least partially through chamber 114.

Although not particularly shown in the Figure presently being discussed, but which will be shown and discussed in greater detail hereinbelow, when a ball is expelled from first chamber 102*a* into second chamber 114, the ball's movement or travel path to holding bin 118 may be impeded while the ball is traveling through second chamber 114. Various elements and/or mechanisms may be used to impede or otherwise alter the travel path. For example, helical or spiral "slide" 116 receives the ball and causes the ball to rotate down slide 116 in a spiral, downward motion, with the endpoint being holding bin 118. As will be discussed in greater detail hereinbelow, other randomizing elements and/or mechanisms may be used so that, even though a ball enters second chamber 114 first or before another ball, the ball may actually end up exiting second chamber 114 into holding bin 118 after the other ball or balls. This may add an element of chance to the game.

Device 100 may also have top 120 having indicia that adds to the appearance of device 120. Top 120 may also have cover 122 which, as with top 120, may also add to the appearance and/or functionality of device 100. Specifically, and in the embodiment illustrated, cover 122 takes the shape and form of a hat, the hat having a center portion and a brim. Conveniently, and according to the design of this embodiment, the channel formed between the center portion and the brim can be utilized to hold and/or to store the balls when not in play or use.

Although not limited to a particular set of materials or manner of construction, in some embodiments, device 100 is primarily constructed of various formulations of plastic. Second chamber 114 may be constructed of a see-through plastic. Pressure mechanism 110 may be constructed of deformable, low density polyethylene or other deformable, shape-recoverable plastic. Thus, pressure mechanism 110 preferably is constructed of a material that retains its shape after repeated deformation, in order to allow for multiple compressions during a number of plays and/or uses, and consistent with the expected life of the product.

Figures 2, 3, 4:
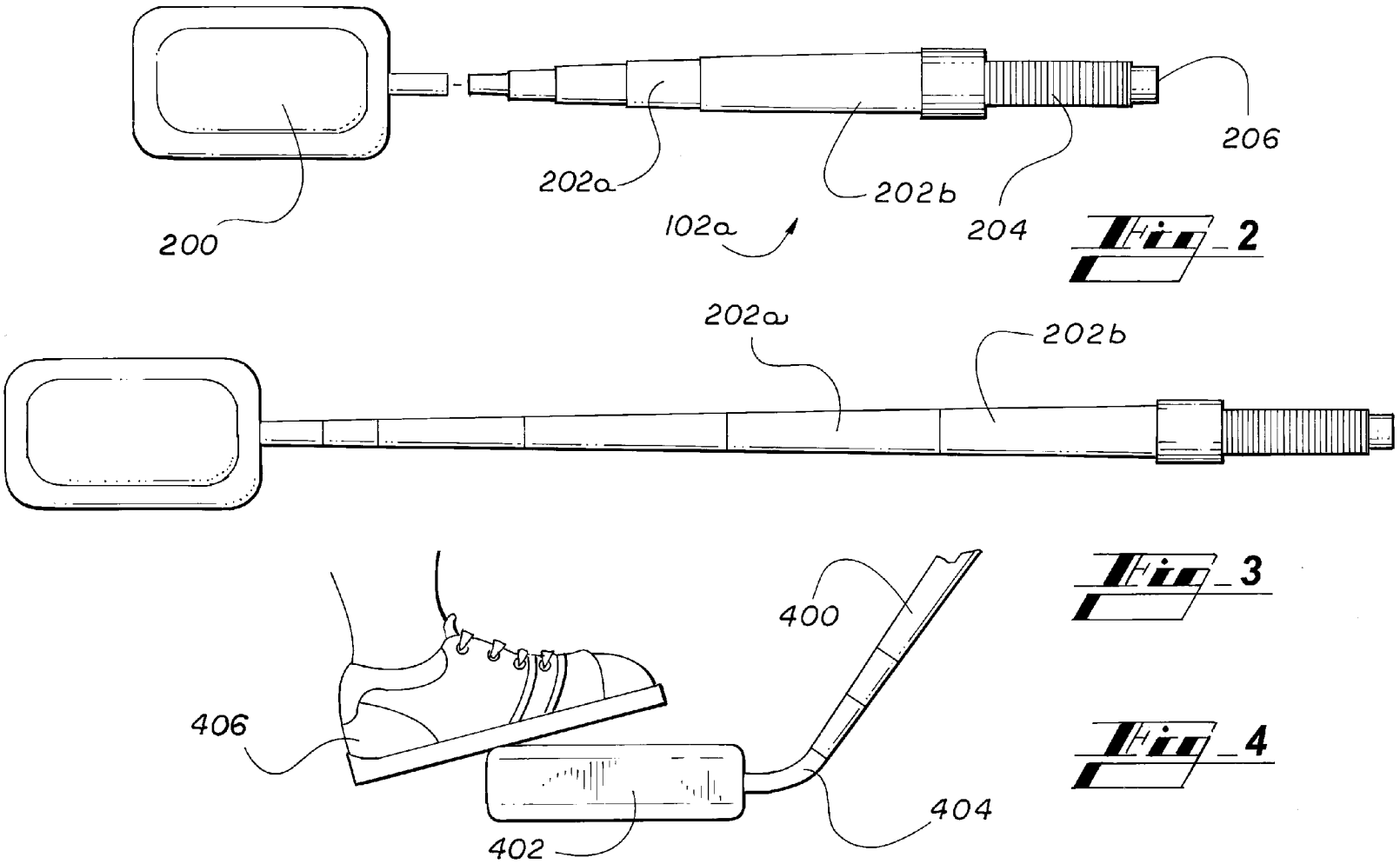
FIG. 2 is an exemplary illustration in plan view showing the first chamber and the pressure mechanism in partially collapsed configuration.
FIG. 3 is an exemplary illustration in plan view showing the first chamber in fully extended configuration and connected to the pressure mechanism.
FIG. 4 is an exemplary illustration in elevation view showing a participant in the act of compressing the pressure mechanism.

FIG. 2 is an exemplary illustration of the construction of first chamber 102*a*. Shown is pressure mechanism 200 which, when compressed like pressure mechanism 110 of FIG. 1, creates an increased pressure within first chamber 102*a*. It will be appreciated that one may desire to extend or retract chamber 102*a* for purposes of space-accommodating and/or space-saving play, and for storage of game device 100 when not in use. Thus, in order to extend or retract chamber 102*a*, chamber 102*a* may comprise sections that fit within each other; for example, in telescoping arrangement. In keeping with such desirable attributes, illustrated are exemplary sections 202*a* and 202*b*. Section 202*b* has a diameter that is of a size suited for the insertion of section 202*a* within section 202*b*. Additionally, the diameter of section 202*b* may vary, for example, in conical (tapered) form, so that section 202*a* cannot be easily or readily removed or extended outside of section 202*b*; thus, securing section 202*a* within section 202*b*. It will be apparent to those of ordinary skill in the art that a plurality of equivalently configured sections 202 may be provided in order to accommodate a preferred total length, a preferred pressure characteristic, a preferred total device size and/or height, a maximum and/or minimum preferred chamber 202 diameter, or the like, without limitation. It is also here noted that non-circular shaped sections comprising chamber 202 may be utilized without departing from the scope or spirit of the present invention. By way of non-limiting example, the sections of chamber 202 may be of oval cross-section, and may be tapered in the manner described above.

Shown also are flexible connector 204 which, in some embodiments, provides for the movement of chamber 102*a* about various axes of rotation and in varying degrees of freedom. Also shown is aperture 206 which provides for air flow through chamber 102*a*, from pressure mechanism 200 and toward aperture 206, and which subsequently serves to expel a ball from chamber 102*a*.

FIG. 3 shows chamber 102*a* in a fully extended configuration. Section 202*a* is shown as having been extended substantially outside of the inner space of section 202*b*. To secure section 202*a* to section 202*b*, in some embodiments, the outer diameter of the portion of section 202*a* not extended outside of section 202*b* is greater than the inner diameter of the end of section 202*b*. As noted above with reference to FIG. 2, a plurality of equivalently configured sections 202 may be provided for the purposes noted.

FIG. 4 illustrates the use of the pressure mechanism to expel a ball. In this embodiment, first chamber 400 is connected to pressure mechanism 402 via elbow joint 404. When a participant pushes his or her foot 406 down onto pressure mechanism 402, the void in pressure mechanism 402 is collapsed, at least partially; thereby, increasing the air pressure within first chamber 400. That increase in air pressure pushes against the ball, which is preferably forcefully expelled from first chamber 400.

Figure 5A:
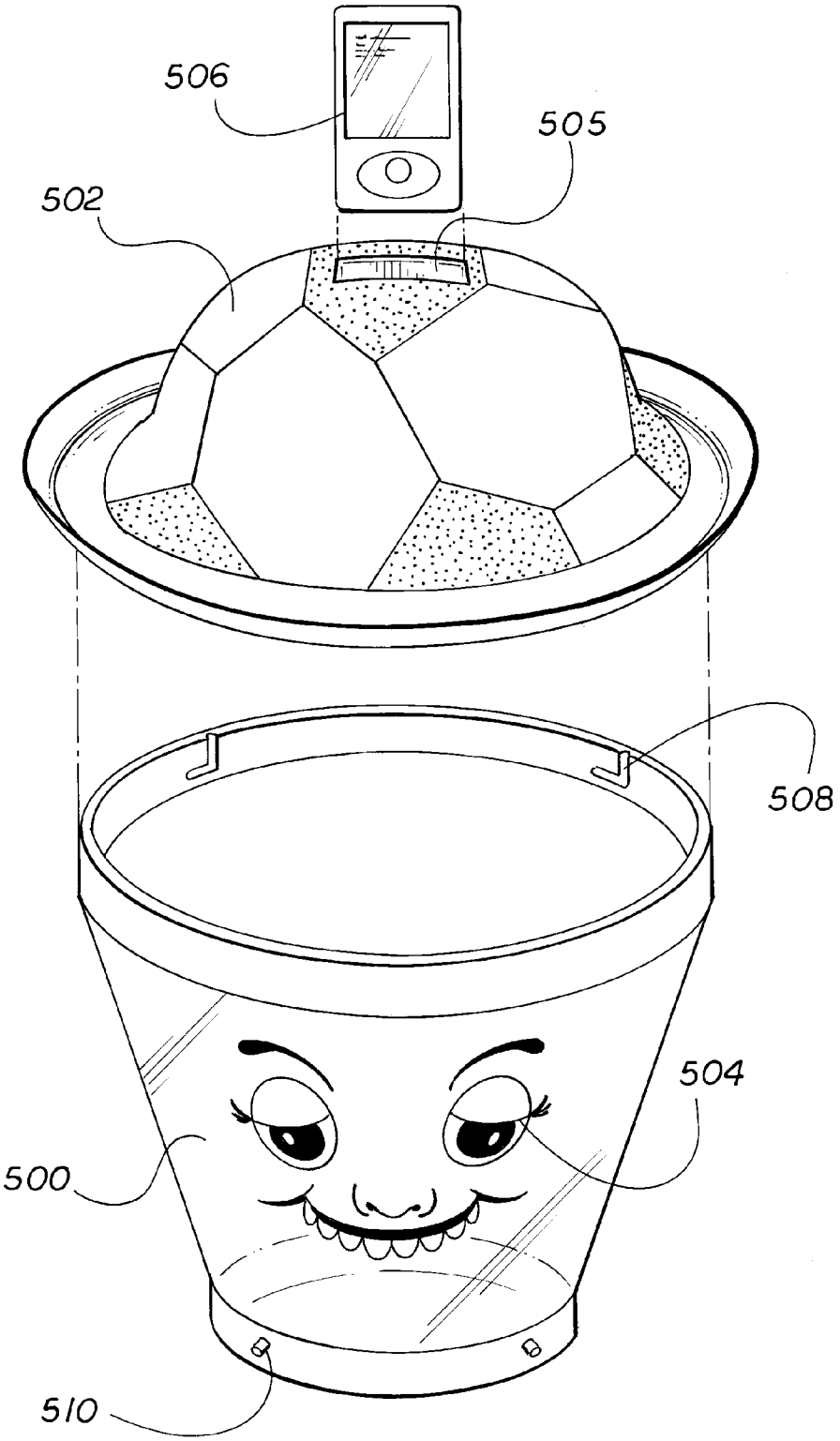
FIG. 5A is an exemplary illustration in perspective view of a second chamber having a dock for a music player device.

As discussed previously, a gaming device of the presently disclosed subject matter may be configured to have the capability to play music. For example, in a manner similar to musical chairs, participants may be positioned at their respective first chambers and, when the music is stopped, the participants may attempt to be the first to depress their pressure mechanism. In another embodiment representative of preferred game-play, the participants may be instructed to perform a particular exercise, calisthenics, or physical activity, such as jumping jacks, running in-place, push-ups, sit-ups, or the like, and/or combinations thereof, while at their station in front of gaming device 100 and, when the music stops, the participants may then attempt to be the first to depress their assigned pressure devices associated with respective chambers having balls disposed therein. Accordingly, with this preferred, relatively safe, method of game-play in mind, shown in FIG. 5A is top 500 with cover 502. To enhance top 500, top 500 may have decorative indicia 504. Cover 502 may also be formed in decorative shapes or use decorative indicia. In this instance, cover 502 is shown resembling a hat comprising a soccer ball design. As was noted hereinabove, a channel formed between the center portion and the brim of hat-shaped cover 502 can be utilized to hold and/or to store the balls when not in play or use.

To play music, cover 502 may have receiving aperture 505 which receives one or more types of computing devices, such as mp3 player 506, or a player of such other digital music format(s) as now known or which may be subsequently developed. Player 506 may be in electrical communication with internal sound playing computing devices disposed in various physical locations within game device 100 using various connection mechanisms. For example, the connection mechanism may be a cable or a "dock." When player 506 is configured to output music files to game device 100, game device 100 is configured to receive those files and to subsequently output the files as sound. This may be an automatic process, such as a software program run by player 506 or game device 100, whereby music is randomly, or apparently randomly to the participant, started and/or stopped. Alternatively, player 506 in association with game device 100 may be configured to be controlled according to a manual starting and/or stopping process, such as with a remote control device as is well-known in the art.

In one example, cover 502 is removably attached to top 500 using a pin-groove system 508, in which a pin on top 502 is placed within groove 508, and is lowered and rotated to the extent of groove 508 in order to secure cover 502 to top 500. An example of such a pin is pin 510, which may be used in a similar manner to removably attach top 500 to a second chamber, such as second chamber 114 of FIG. 1.

Figure 5B:
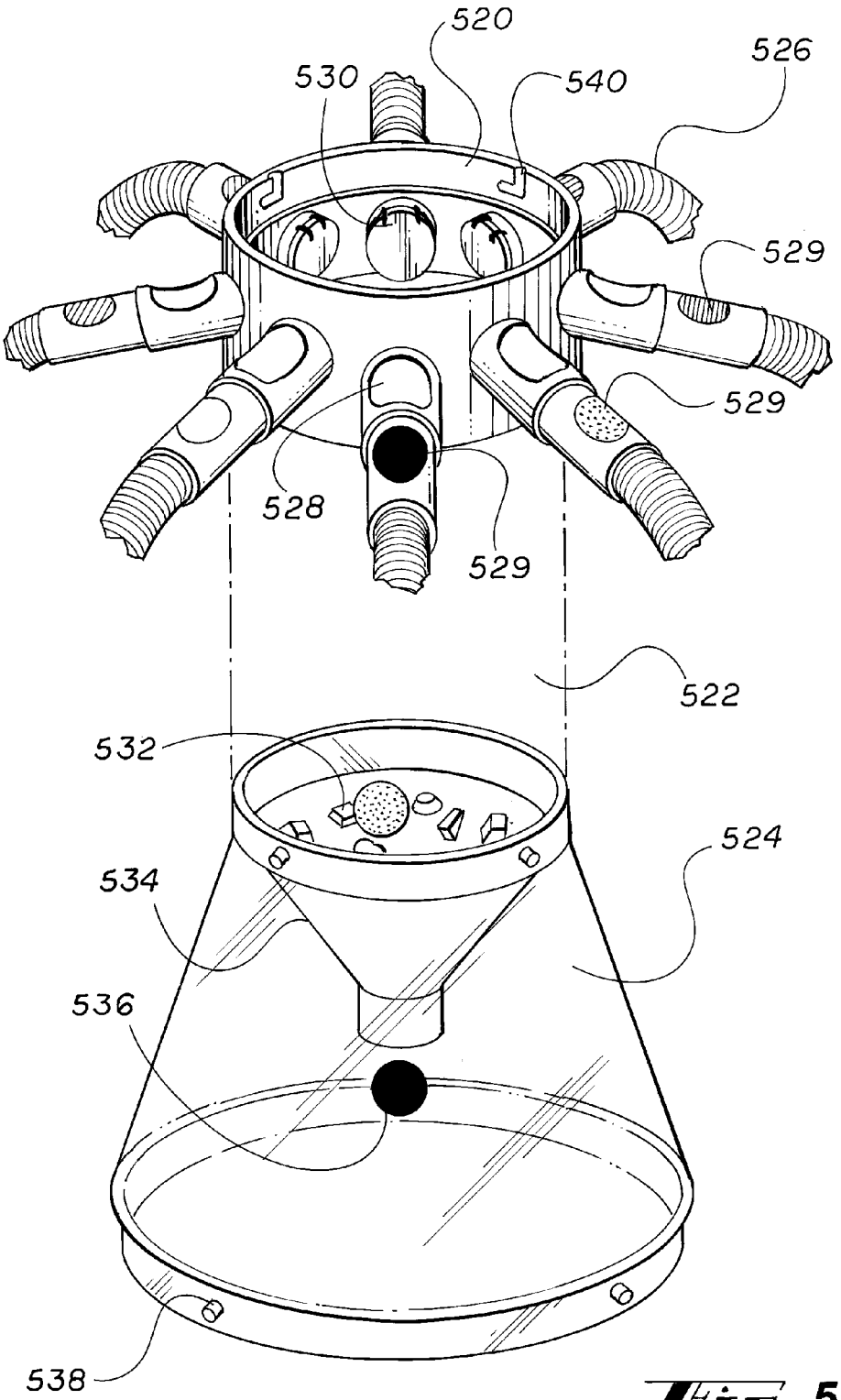
FIG. 5B is an exemplary illustration in perspective view showing one possible configuration of a plurality of first chambers in association with one possible configuration of a second chamber.

FIG. 5B is an exemplary illustration of a second chamber, such as second chamber 114 of FIG. 1. In this embodiment, second chamber has three main sections; to wit, upper section 520, middle section 522 and lower section 524. These sections may be connected in various ways or may be constructed in a single, integral unit. Upper section 520 is the receiving portion in which the first chambers, such as first chamber 526, connect to the second chamber. A ball may be placed in ball holding mechanism 528 and expelled into the second chamber, the ball exiting the first chamber through hinged door or flap 530.

Holding mechanism 528 may have indicia or other elements 529 to show which particular ball of the plurality of game-play balls should be and/or is disposed therein. As may be conveniently seen with continued reference to FIG. 5B, each first chamber 526 may have indicia 529 that designates a particular color, number, letter, and/or design carried by a ball intended to be associated with that particular game device station. In this manner, a participant is assigned, or voluntarily selects, a unique ball, and is then associated with the corresponding station, and play may ensue accordingly.

When a ball is expelled from a first chamber into the second chamber through hinged door 520, the ball travels into middle section 522. As discussed above, the second chamber may have devices, elements, and/or mechanisms that obstruct, alter, randomize, or otherwise change the path of a ball traveling through the second chamber. In one embodiment, FIG. 5B shows filter 532 with such elements extending from the surface of filter 532 that change or alter the travel of the ball going through middle section 522. The ball may bounce around on filter 532 until it reaches an aperture or opening that permits the ball to enter funnel 534, which directs the ball into lower section 524. Again, it should be noted that the use of any or all devices that change the travel path of a ball through the second chamber are optional and may be used separately or in combination. Accordingly, filter 532 may be designed as a plate resting atop funnel 534, and the plate may be installed, or not, by the participants as they may desire.

As discussed above, and with continuing reference to FIG. 5B, the various elements of the game device may be connected in various ways. Accordingly, shown are pin 538 and groove 540 which are used to either place into a groove or receive a pin from another section and to interconnect the various sections.

Figure 5C:
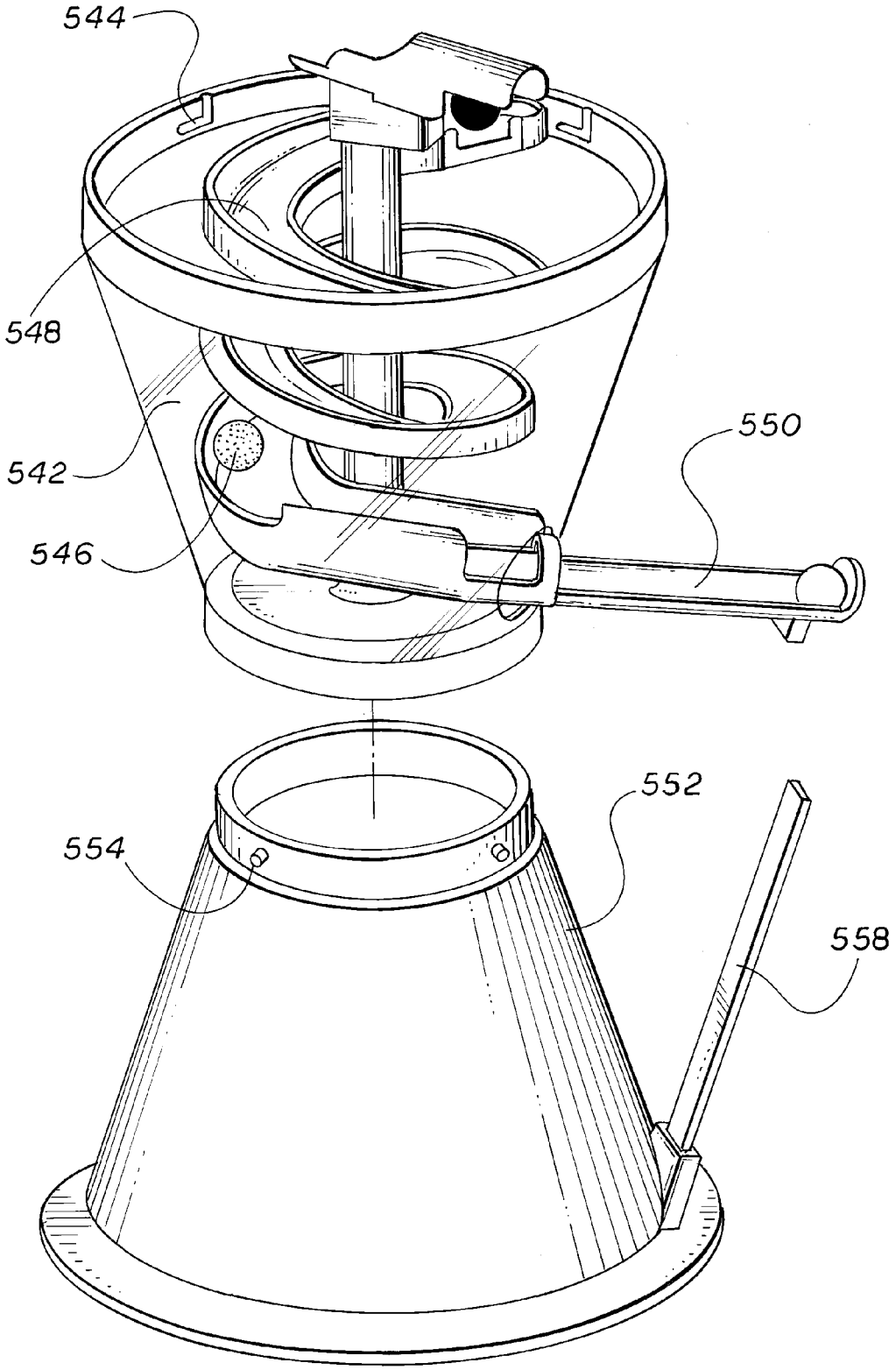
FIG. 5C is an exemplary illustration in perspective view showing one possible configuration of a second chamber and an associated support base.
Figure 7:
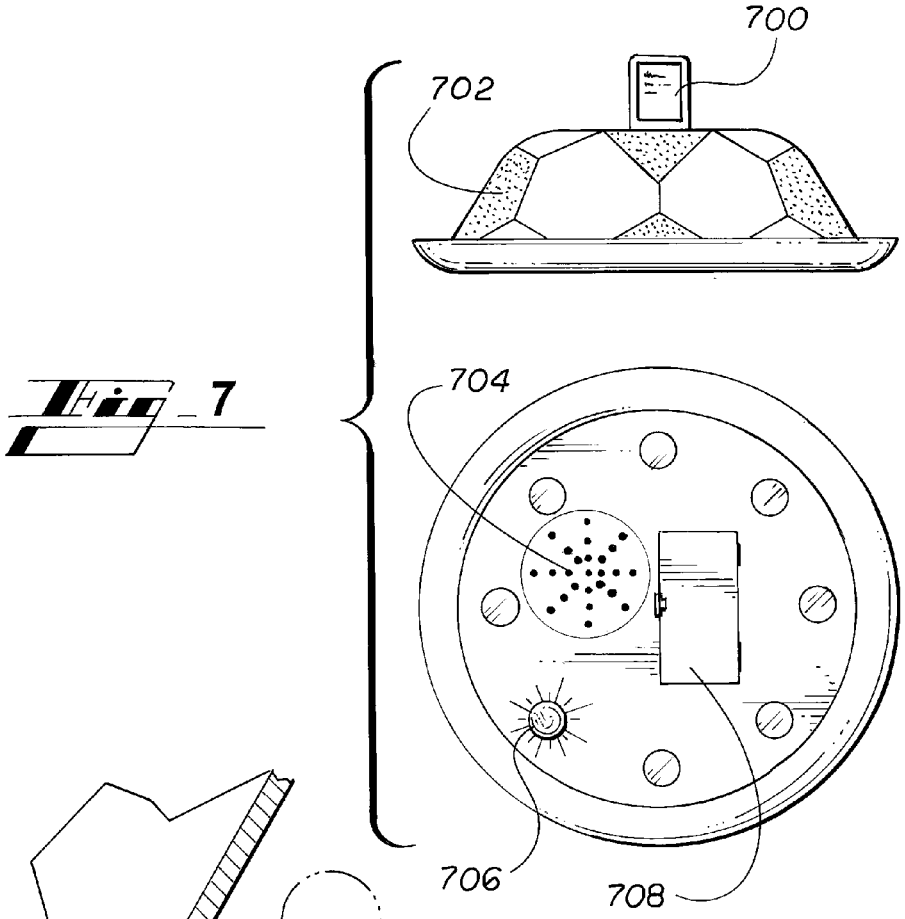
FIG. 7 is an exemplary illustration in bottom and elevation views showing how lights and music inputs may be used.

FIG. 5C shows the internal construction of a bottom section of a second chamber. Shown is bottom section 542, which in some embodiments, is connected to lower section 524 of FIG. 5B using pin 538 in groove 544. In this embodiment, once ball 546 exits lower section 524, the ball is directed onto slide 548 and exits bottom section 542 into holding bin 550. In some embodiments, if more than one ball is used, the balls will line up in holding bin 550 in the order that they exit lower section 524. To keep track of which ball exited which first chamber, the balls may be marked using colors, numbers, letters, designs, or other identifying indicia. To provide stability to the game device and/or to raise the second chamber, bottom section 542 may be connected to base 552 using a similar pin-groove configuration using pin 554 as an example. To secure or stabilize bin 550, securing mechanism 558 may be used.

Figure 6:
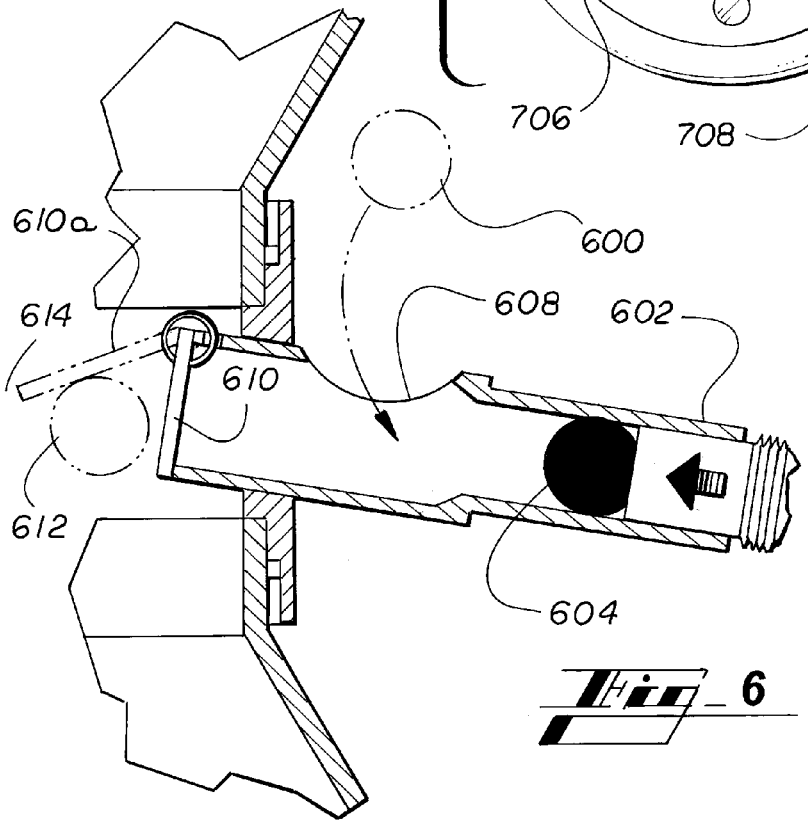
FIG. 6 is an exemplary illustration in sectioned elevation view showing how a ball may be loaded into, and is subsequently disposed within, an exemplary first chamber.

FIG. 6 is an exemplary cut-away illustration of a ball disposed within a first chamber. Ball 600 is shown in a position outside of first chamber 602. Ball 600 is placed in first chamber 602 ball holding mechanism through ball-loading, and air pressure venting, aperture 608, to rest at position 604. When a participant pushes on a pressure mechanism (not shown) of first chamber 602, air pressure forces the ball from position 604 onto hinged door 610, pushing open hinged door 610 from its closed position to position 610*a*. Ball 600 is, thusly, expelled from chamber 602 into position 612 and exits into second chamber 614.

As discussed previously, game device 100 may be configured to play music. Music device 700 may be in electrical communication with game device 100 using a connection disposed in cover 702. The music file may be output to speaker 704, located adjacent the bottom of game device 100, or, alternatively and preferably, adjacent the bottom of cover 702. Game device 100 may also have lights, LEDs, or other forms of visually perceptible indicators 706, to signal certain events, such as the winning first chamber, or to provide stimulation or other entertaining or informative effects to the participants and/or spectators. For example, in situations wherein one or more of the participants may be aurally impaired, the lights may be configured to provide a visual indicator to the participants that it is time to depress their respective pressure mechanisms. To power the device, a battery may be disposed within battery compartment 708. In some embodiments, game device 100 may be powered through an electrical cord plugged into a wall outlet or other electrical power source. In other embodiments, game device 100 may be powered through solar energy.

Figure 8:
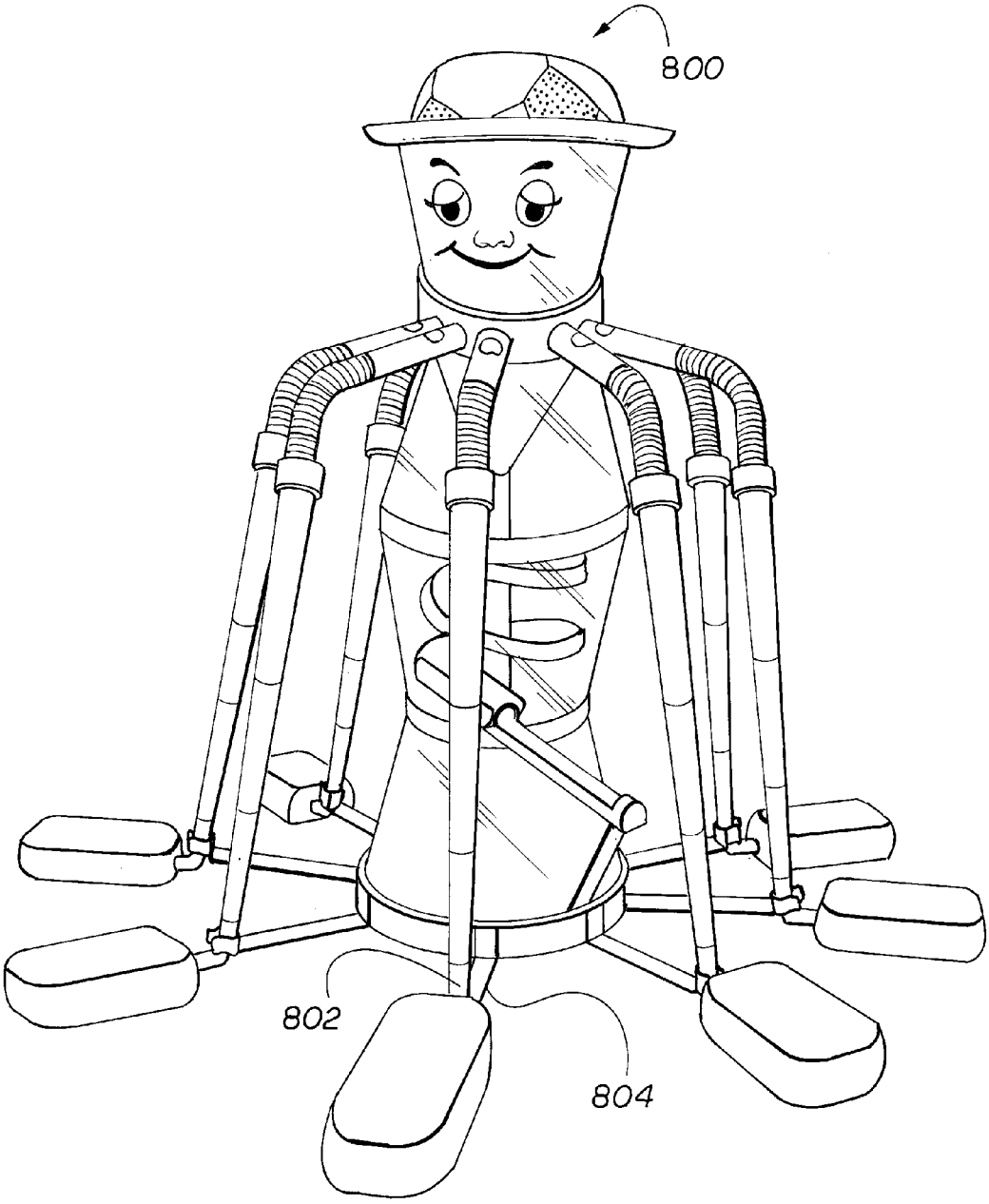
FIG. 8 is an exemplary illustration in perspective view showing the plurality of the first chambers in a space-conserving configuration.

Because the first chamber may be flexibly attached to the second chamber of a game device, it may be preferable in some embodiments to secure the first chamber in a certain position. This may be preferable in order to conserve space, to stow the game device when not in use, to stabilize the game device during play, or to bring smaller participants into closer proximity for game-play. Accordingly, FIG. 8 illustrates a basic securement of a first chamber. Game device 800 has first chamber 802 flexibly attached; i.e. first chamber 802 may, in an unsecured configuration, be moved about various axes of rotation. In order to secure first chamber 802 in a certain position, then, securement device 804 is used. Securement device 804 is attached to the base of game device 800 and is of a fixed length. The fixed length, accordingly, serves to secure first chamber 802 in a defined position.

Figure 9:
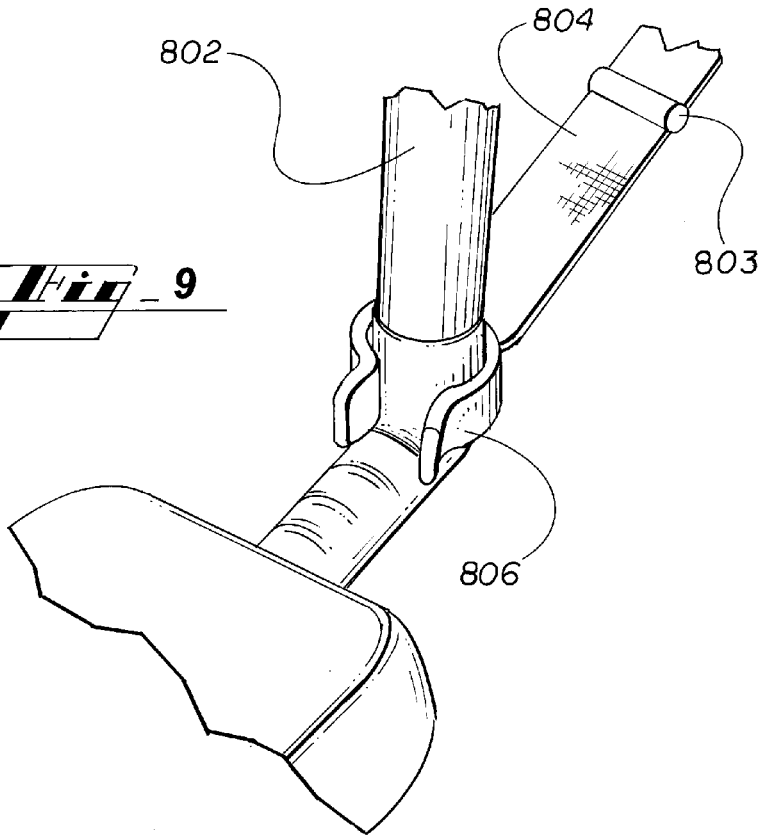
FIG. 9 is an exemplary illustration in perspective view showing the securement of a first chamber.
Figure 10:
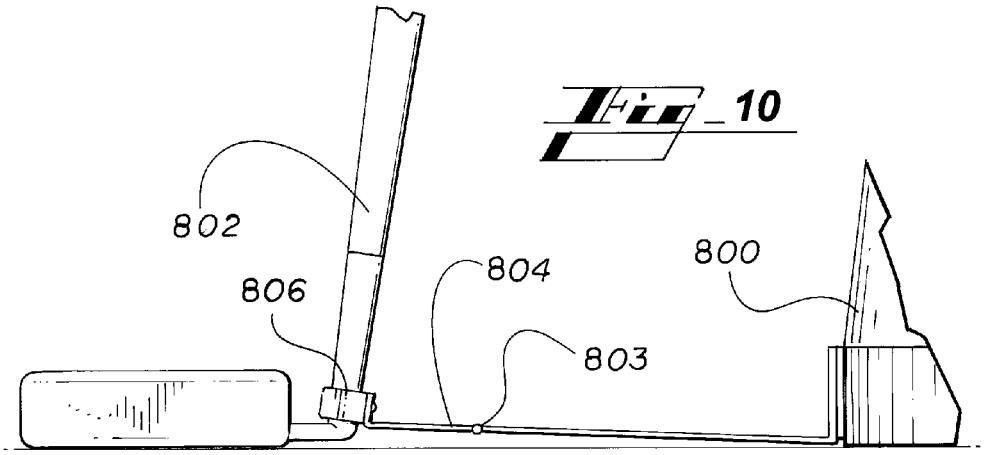
FIG. 10 is an exemplary illustration in elevation view showing the securement of the first chamber.

FIG. 9 provides a close-up illustration of securement device 804. First chamber 802 is secured to securement device 804 by collar 806, which snaps onto first chamber 802, preferably at an elbow joint, as described hereinabove. As shown, collar 806 has an opening that allows for the removal of first chamber 802 from collar 806. FIG. 10 is a side view of this exemplary configuration. First chamber 802 is secured to securement device 804 by placing first chamber 802 into collar 806. Securement device 804 is connected to the base of game device 800. In some embodiments, a constrained hinge 803, or equivalent, may be used to provide a small degree of adjustability in the position of first chamber 802.

Figure 11:
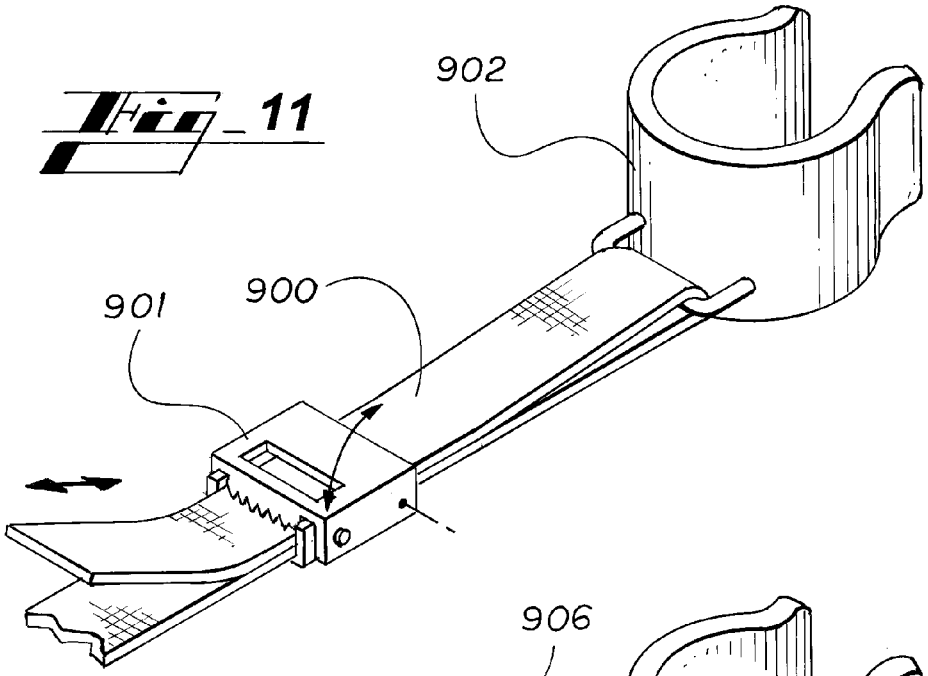
FIG. 11 is an exemplary illustration in perspective view showing one possible configuration that may be used to secure the first chamber.

In some embodiments, the secured position of first chamber 802 may be changed by changing the length of securement device 804. Thus, FIG. 11 shows securement device 900 being a variable length strap. The length of securement device 900 may be increased or decreased using buckle 901. As before, a first chamber is secured to securement device 900 through the use of collar 902. It should be noted that the use of collar 902 is merely to illustrate one way in which the first chamber may be secured to a securement device. This illustration should not be interpreted as a limitation on the scope of the disclosed subject matter.

Figure 12:
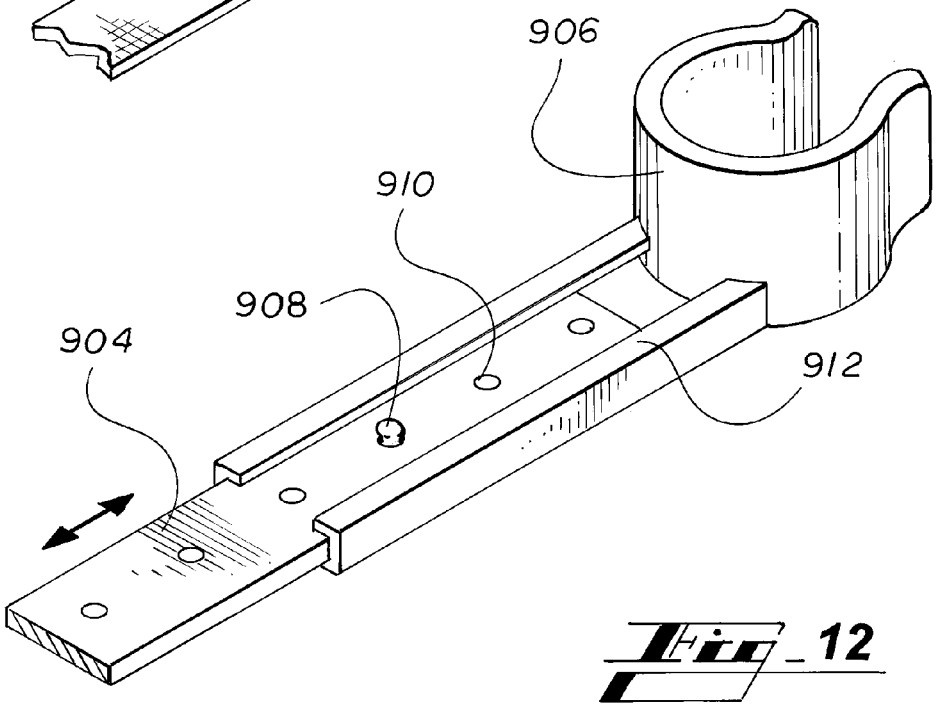
FIG. 12 is an exemplary illustration in perspective view showing an alternate possible configuration that may be used to secure the first chamber.

FIG. 12 illustrates yet another way in which the length of a securement device may be adjusted. Shown is securement device 904 with a pin-hole strap. The length of the strap of securement device 904 is adjusted by changing the hole 910 in which pin 908 is engaged. In other embodiments, a strap and channel arrangement may be used, either alone or in association with other securement elements. In such embodiment, and as may be seen by continuing reference to FIG. 12, the strap is directed into channel 912, whereupon pin 908 may be engaged into a hole 910. Securement device is connected to collar 906 which receives a first chamber for securement.

In view of the above-described embodiments, it should now be appreciated that the present innovation presents a new form of interactive game, and associated game-play, modeled loosely upon the game of musical chairs. The new and innovative game has, through careful and creative design, removed as many of the potentially dangerous, destructive, and otherwise deleterious aspects of the original musical chairs game as possible, while substituting therefor one or more safe, positive, and exciting game-play attributes.

For example, it has been demonstrated that the elements of randomness and/or chance could be, and have been, maintained through allowing randomness and/or chance to be introduced into the game by means present in the original game; to wit: by the starting and stopping of the music, by the speed of auditory processing by each participant, and by the physical speed and prowess of each participant. It has been further demonstrated that this new game can be combined with physical movement, exercise, and activity, and/or combinations thereof, on the part of the participants, but in a way that these elements and attributes may avoid physical injury to both participants and surroundings, principally by avoiding impact, collision, bumping, smashing, or the like, of persons and/or property during game-play.

Although the preferred embodiments have been described with particularity hereinabove, it will be recognized that certain modifications may be effectuated without departing from the scope and spirit of the inventive disclosure. For example, in lieu of a music player, game-play may be controlled via vocally-given keywords, such as "STOP," "GO," and/or the like. Similarly, game-play may be varied to include additional elements of chance and/or randomness, as by, for example, defining in advance of a particular round of play that the winning participant of that round shall be declared by, not the first ball out, but by the second, third, fourth, or the like. Still further, the winning participant may be determined by elimination in successive rounds; or, by allowing each participant to stay "in" each round, and adding up the total number of wins across successive rounds. Similarly, winners may be determined by rule variants subject only to the creativity of the participants; to wit, by increasing points assigned at each round; by incrementing the winning ball position at each round (i.e., the winner of round one is determined by the first ball out; the winner of round two is determined by the second ball out; and the like); and other such variants, without limitation. It will be further apparent that the game device may be of design, color, or otherwise, uniquely associating a station, ball, and participant; alternatively, each station may be multicolored, as through the use of multicolored segments within each first chamber, or the like, to make the game device more visually impactful.

Accordingly, while the subject matter of the present invention has been described in connection with the preferred embodiments of the various Figures, it is to be understood that other and/or similar embodiments may be used, and that modifications and additions may be made to the described embodiments for performing the same or similar unique function without departing from the scope and spirit of the present invention. Therefore, the disclosed embodiments should not be limited to any single embodiment but, rather, should be construed in breadth and scope in accordance with the appended claims.

What is claimed:

1. A game device comprising:

a plurality of first chambers, wherein each first chamber of the plurality of first chambers comprises a ball-holding mechanism disposed therein;

a plurality of pressure mechanisms, wherein each pressure mechanism of the plurality of pressure mechanisms is connected to one of the plurality of first chambers, and whereby a ball is expelled from a first chamber when a pressure mechanism connected thereto is activated;

a second chamber comprising a funnel formed therein, wherein the funnel is configured to receive a plurality of balls and to allow each ball of the plurality of balls to exit one ball at a time from the funnel, wherein each first chamber of the plurality of first chambers opens into the second chamber; and a holding bin configured to receive and collect the plurality of balls in an order of exit from the funnel.

2. The game device of claim 1, wherein each first chamber of the plurality of first chambers further comprises at least two sections connected in a telescoping arrangement.

3. The game device of claim 1, wherein each first chamber of the plurality of first chambers is connected to the second chamber by a flexible connector.

4. The game device of claim 1, further comprises a spiral slide configured to receive a ball from the second chamber.

5. The game device of claim 1, wherein the holding bin is cylindrical.

6. A game device comprising:

a body comprising a central ball-receiving chamber formed therein, wherein the central ball-receiving chamber comprises a funnel formed therein;

a plurality of legs connected to the body, wherein each leg of the plurality of legs comprises a ball-activating chamber having a first end and a second end, a ball-holding mechanism disposed in the ball-activating chamber, a hollow compressible foot pad connected to the first end of the ball-activating chamber, and an aperture open to the central ball-receiving chamber, wherein a ball disposed in the ball-activating chamber is expelled into the central ball-receiving chamber when the hollow compressible foot pad is compressed; and, a holding bin configured to receive a plurality of balls one ball at a time from the funnel and collect the plurality of balls in an order of exit from the funnel.

* * * * *